US005270993A

United States Patent [19]

Besson et al.

[11] Patent Number: 5,270,993

[45] Date of Patent: Dec. 14, 1993

[54] METHOD FOR DETECTING THE ZERO POSITION OF A HAND OF A QUARTZ WATCH WITH ANALOGUE DISPLAY, A DEVICE FOR PERFORMING THIS METHOD AND A WATCH FITTED WITH THIS DEVICE

[75] Inventors: René Besson, Geneva; Claude-Eric Leuenberger, Geneve-Acacias, both of Switzerland

[73] Assignee: Montres Rolex S.A., Switzerland

[21] Appl. No.: 605,551

[22] Filed: Oct. 30, 1990

[30] Foreign Application Priority Data

Nov. 3, 1989 [CH] Switzerland ..... 03978/89

[51] Int. Cl.[5] ..... G04B 19/04

[52] U.S. Cl. ..... 368/80; 368/187; 368/184

[58] Field of Search ..... 368/157, 160, 187, 76, 368/80, 155, 228

[56] References Cited

U.S. PATENT DOCUMENTS 4,420,263 12/1983 Besson et al. ..... 368/187

4,645,357 2/1987 Algaier et al. ..... 368/187

*Primary Examiner*—Bernard Roskoski

*Attorney, Agent, or Firm*—Davis, Bujold & Streck

[57] ABSTRACT

The device for performing the method for detecting the zero position of a hand of a quartz watch with analogue display enables a beam of light to be generated and directed onto a reflective surface integral with a moving part bearing the hand, the reflected beam to be received on a detector and the position for which the output signal of the detector is maximal to be determined to make it correspond to the zero position of the hand when assembling the watch. This device comprises a source (1) emitting a beam of light (2) and a receiver (3) which intercepts the reflected beam (4) returned by a very reflective area (5). This area is integral with a surface of a moving part (6), for example the wheel bearing the second hand and, depending on the position of this wheel, the reflective surface may occupy a position (5) or an adjacent position (5') staggered by less than one step. The signals from the detector (3) are transmitted to an electronic ciruict (7) connected to an electric motor (8) which drives the moving body (6) by means of a train of wheels (9).

1 Claim, 3 Drawing Sheets

| | GROUPE I | GROUPE II |
|---|---|---|
| A1 | 102 - 103 - 104 - 105 | 101 - 106 - 107 - 108 - 109 - 110 |
| A2 | 103 - 104 - 105 - 106 | 101 - 102 - 107 - 108 - 109 - 110 |
| A3 | 104 - 105 - 106 - 107 | 101 - 102 - 103 - 108 - 109 - 110 |
| A4 | 105 - 106 - 107 - 108 | 101 - 102 - 103 - 104 - 109 - 110 |
| A5 | 106 - 107 - 108 - 109 | 101 - 102 - 103 - 104 - 105 - 110 |

METHOD FOR DETECTING THE ZERO POSITION OF A HAND OF A QUARTZ WATCH WITH ANALOGUE DISPLAY, A DEVICE FOR PERFORMING THIS METHOD AND A WATCH FITTED WITH THIS DEVICE

The present invention relates to a method for detecting the zero position of a hand, for example the second hand, of a quartz watch with analogue display.

It also relates to a device for performing this method.

Finally it relates to an electronic watch fitted with this device.

An electronic watch with analogue display essentially comprises a quartz, the vibrations of which are maintained by an oscillator, an electronic chain for dividing the frequency of the quartz and a control circuit for a stepping motor advancing at the rhythm of one step per second, with the unit being powered by an electrochemical battery. The stepping motor is coupled to a long mechanical kinematic chain, which reduces the speed of rotation of successive moving parts, such as the hands, for the purpose of displaying the second, the minute and the hour, and disks for displaying the date and day of the week. This kinematic chain is entirely suitable for displaying the time, and there is no uncertainty when reading the time. In fact, the minute is on a minute mark when the second passes through zero; the same applies for the hour with respect to the minute, and, finally, the date and the day change at midnight. In certain designs, this kinematic chain has to be interrupted to enable rapid corrections to be made to the date and day, or to create the time zone function. The division of this kinematic chain to make it more flexible in use has been known for a long time. This principle was put into application in a concept where each mechanical display possesses its own drive motor for the purpose of facilitating corrections and/or displaying other functions.

Nevertheless, very few designs were developed on an industrial scale, as although it is relatively easy to make a horological construction in which the kinematic chain is divided and where each part is powered by its own motor, on the other hand it is difficult to ensure the synchronisation of one display with the next. In other words, when the second passes zero, it is necessary that the minute is located exactly on its mark so as to avoid any uncertainty in the reading.

So as to perform this synchronisation of the displays by electronic means, it is imperative to "know" electronically the passage of the second hand through zero so as to be able to give, at that precise instant, a pulse to the motor driving the minute hand, so that it arrives on a minute reference mark.

Of course there is a large number of devices which enable one to know at each movement of a moving part its displacement or its position. These devices can not be applied to horology, principally for reasons of energy consumption and space. With respect to the second hand, the problem of detecting its position can be simplified. In fact, this hand makes a full rotation every 60 seconds in normal operating mode and in high-speed operation (time setting) it may make a full rotation, i.e. 60 steps, in less than one second. In connection with this dynamism of speed and the objectives pursued, it is possible to restrict oneself to a device which will identify one step from the 60 corresponding to one revolution, this step being defined as the zero step.

For this reason, these devices are usually designated as "passage through zero detectors". When the watch is assembled, this zero detection device is operated as follows: The electronic system gives the motor the order to advance step by step until it receives the information that the zero step has been reached. In this position, the horologist moves the second hand on its axle, exactly onto the zero of the display. With every revolution of the second hand this position should reoccur, and it is easy for the electronic system to know that, for example ten steps after passing through zero, the hand has to be on the second 10. Thus, when the electronic system reaches the value zero, if the information for passage through zero has not been received, the motor will advance at high speed until the zero information is obtained. In practice this system is adequate to achieve the desired object. In fact, only large shocks to the watch, or entry into high magnetic fields, bring about a difference between the electronic scaling of the position and the actual position displayed by the hand. These accidents, which are very rare, can not occur during the activation of the functions of the watch by the crown or push buttons.

Horological industrial designs for detecting the passage through zero are not numerous and most of them are based on detection by means of a mechanical contact. However, an optical system which consists of an electroluminescent diode emitting infrared light onto the second wheel has also been used. The wheel comprising a hole performs the role of an obturator and the beam of light falls or does not fall onto a photosensitive cell disposed opposite the diode. This is the way in which an electronic signal is obtained which indicates the passage through the zero position.

The drawback of this system is that, during assembly, orientations orders for the wheel have to be applied in such a way that in the position of rest the optical path is completely free or completely blocked. Intermediate cases interfere with operation and should therefore be avoided.

The object of the present invention is to circumvent these drawbacks by proposing a method and a device which obviates the need for the assembly department, and also the aftersales department, to locate precise reference marks before positioning the second hand.

To achieve this aim, the method according to the invention is characterised in that a beam of light is generated and directed onto a surface integral with a moving part bearing the hand, this surface comprising a slightly reflective zone and a very reflective area, in that the beam reflected by this slightly reflective zone and/or by the very reflective area is received on a detector formed by a set of photovoltaic cells, and in that the position for which the output signal of the detector is maximal is determined to make it correspond to the zero position of the second hand during the assembly of the watch.

To determine the position for which the output signal of the detector is maximal, the set of photovoltaic cells is preferably subdivided into two groups, a first central group comprising p cells, and a second lateral group comprising n-p cells, the total number of photovoltaic cells of the set being n, and the ratio of the currents respectively from these two groups, and the maximum value for this ratio are determined.

The first group of p cells is chosen in such a way that the cells which it comprises are switched between the n-p cells of the second group.

If the detector has ten photovoltaic cells, the first group may advantageously comprise four cells and the second group may comprise six cells, so as to define five possible arrangements of the cells.

These groups having been formed, a threshold value $k_1$ for the ratio of the currents from the two groups is determined, said surface integral with the moving part bearing the hand is turned to determine the positions for which the ratio of said currents exceeds said threshold value, for each position the possible arrangements of cells is tested, the arrangement for which the ratio is maximum is determined, and this arrangement is memorised.

The polarity of the step of the motor performed at the moment when this ratio was detected is also memorised.

So as to position said hand, the arrangement for which the ratio is maximal is preferably determined in advance, this arrangement is memorised and said hand is fixed on to the moving part by positioning in its "zero" position corresponding to the numeral "twelve" on the face of the watch.

Then, once every revolution, the real mechanical position of the hand is compared with the theoretical position determined by electronic scaling.

To make this comparison, a threshold value $k_2$ lower than the value of the maximal ratio of the currents from the cells of the first and second group of cells in the previously memorised arrangement is determined, and the ratio of these currents at the moment when the theoretical position of the hand is "zero" is compared with this threshold value.

If the value of said ratio is less than said threshold $k_2$, the hand is advanced by at least one step, and the comparison of the new ratio corresponding to the new postion is repeated with this threshold.

The device for performing the method for detecting the zero position of a hand, particularly the second hand, of an analogue quartz watch comprising a drive motor for the hand and an electronic circuit for controlling this motor, is characterised in that it comprises a surface integral with a moving part bearing this hand, comprising a slightly reflective zone and a very reflective area, an emitter designed to emit a beam of light and to direct it onto said surface, a detector formed by a set of n photovoltaic cells designed to detect the beam reflected by said surface, and means for determining the position of this surface for which the output signal of the detector is maximal, and to make it correspond to the zero position of the hand when the watch is assembled.

According to an advantageous embodiment, the set of n photovoltaic cells of the detector is subdivided into two groups, a first central group of p cells and a second group of n-p cells, and the electronic device is designed to calculate the ratio of the currents from these two groups of cells and to determine the maximum value for this ratio.

The p cells of the first group are preferably switched between the n-p cells of the second group.

The detector advantageously has ten cells, the first group having four cells and the second group having six, and the number of possible arrangements is five, bearing in mind that the first and last cell of the set are components of the second group.

According to this embodiment, the electronic circuit comprises means for determining a threshold value $k_1$ of the ratio of the currents from the two groups, and means for determining the positions of the moving part bearing the hand for which the ratio of the currents exceeds this threshold value, and also means for determining the arrangement for which this ratio is maximal.

The electronic circuit is also fitted with means for memorising the arrangement for which the ratio is maximal, and means for comparing, once every revolution, the real mechanical position of the hand with its theoretical position determined by electronic scaling.

The detector advantageously has such a length that the spot formed by the reflected light intercepted by this detector is displaced approximately over all this length when the hand performs a displacement corresponding to one step of the motor.

The length of the detector is preferably less than the length of the displacement performed by the spot of light returned by the reflective surface when the moving part is displaced in rotation by an angle corresponding to two steps of the motor.

The invention will be better understood with reference to the description of an embodiment and to the attached drawings, in which:

FIG. 1 diagrammatically shows a traditional quartz electronic watch,

FIG. 2 ilustrates a kinematic chain divided into three parts,

FIG. 3 diagrammatically shows the device according to the invention,

FIG. 4*a* shows a plan view of the zero detection device,

FIG. 4*b* shows a sectional view of the zero detection device,

Figure 1:
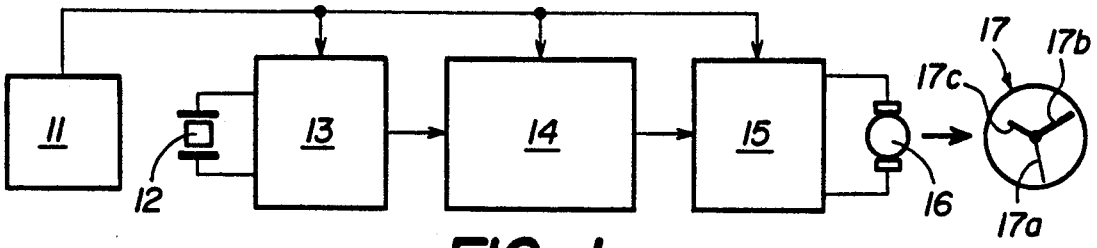

With reference to FIG. 1, a quartz watch with analogue display, which is said to be of the classical type and is described by way of example, comprises a power supply battery 11, a quartz 12, an oscillator 13, an electronic dividing chain 14, a control circuit 15 for a stepping motor 16 which drives the second hand 17*a*, the minute hand 17*b* and the hour hand 17*c* of the mechanical part of the analogue watch 17. The battery 11 powers the circuit of the oscillator 13, that of the frequency divider 14 and the control circuit 15 of the stepping motor 16. These circuits are components of one and the same integrated circuit. The standard quartz 12 has an oscillation frequency equal to 32,768 Hz. The oscillator 13 has a function which consists in maintaining the oscillations of the quartz 12.

The classic electronic dividing chain divides the frequency of the quartz by $2^{15}$ thanks to 15 stages in cascade dividing by two. The output of this chain supplies a signal of 1 Hz to the input of the control circuit 15. The control circuit 15 of the stepping motor 16 supplies it with a voltage designed to make it advance by one step every second. The stepping motor 16 turns by 180° with every step, it drives a train of wheels, or a mechanical kinematic chain which reduces the rotational speed of successive moving parts in such a way that the train of wheels integral with the second hand makes one revolution in 60 seconds, that the train of wheels integral with the minute hand makes one revolution in 1 hour and that the train of wheels integral with the hour hand make one revolution makes one revolution in 12 hours.

In this diagram, the time-setting mechanism is not described. The watch may comprise a date disk, and also a day disk, but the drive mechanism for them is not shown. It should be noted that if these disks exist, the kinematic chain has to be extended to perform its advance once every 24 hours.

Figure 2:
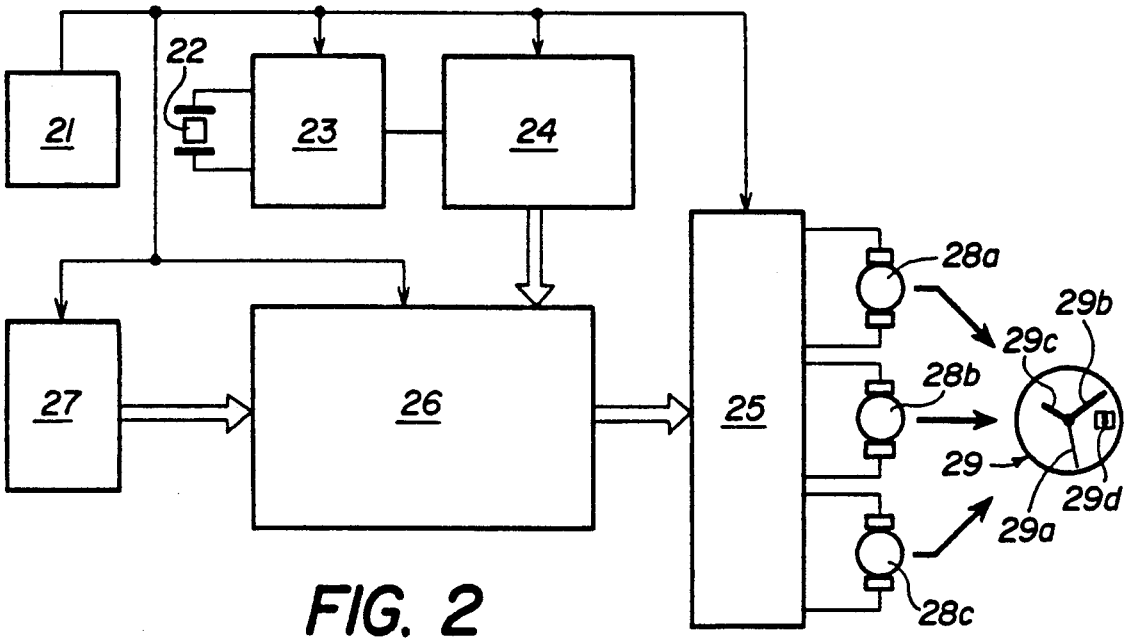

FIG. 2 diagramatically illustrates a watch comprising three independent kinematic chains. As above, it comprises a battery 21, a quartz 22, an oscillator 23, an electronic dividing chain 24 and a control circuit 25 for three stepping motors 28*a*, 28*b*, 28*c*, which are respectively responsible for driving the second hand 29*a*, the minute hand 29*b*, the hour hand 29*c* and the date disk 29*d*, which appears in a window provided in the face 29 of the watch. It also comprises a monitoring circuit 26 and also an input interface circuit 27, the role of which will be described below.

The battery 21 powers the oscillator 23, the frequency divider 24, the control circuit 25 for the three motors, the monitoring circuit 26 and the input interface circuit 27; these circuits are all components of one and the same integrated circuit. In the example described, the quartz 22 is identical to the quartz 12 shown in FIG. 1. The oscillator 23 is identical to the oscillator 13 shown in FIG. 1. The electronic dividing chain 24 is longer than chain 14 of FIG. 1. Apart from the signal of 1 Hz required to control the second hand, a signal of 1/30 Hz has to be supplied for the minute and hour hands, for example if it is wished to advance them by a step of half a minute. It is still necessary to supply a signal of 1/86,4000 Hz, i.e. once every 24 hours, to activate the control of the drive motor of the date disk once a day, at midnight. The control circuit 25 for the three stepping motors supplies them with a voltage designed to make any one of these motors advance. It should be noted that these motors may have one or two directions of rotation. In this FIG. 2 is shown the case of unidirectional motors, but this must not be regarded as a limitation. The monitoring circuit 26 monitors the clock signals supplied by the dividing chain 24 and the signals coming from the input interface circuit 27 which controls the time setting function, for example. This input interface circuit 27 develops the signals produced by electrical contacts integral with the hour setting rod of exterior push buttons, and supplies control signals to the monitoring circuit 26. In this case we talk of electronic time setting.

The motor 28*a* is coupled to the second hand 29*a*, and, in watch mode, this motor advances by one step every second.

The motor 28*b* is coupled to hour hand 29*b* and minute hand 29*c*. In watch mode, this motor advances by one step every half minute, but other values, such as one step every minute or six steps every minute, etc, are possible.

Figure 3:
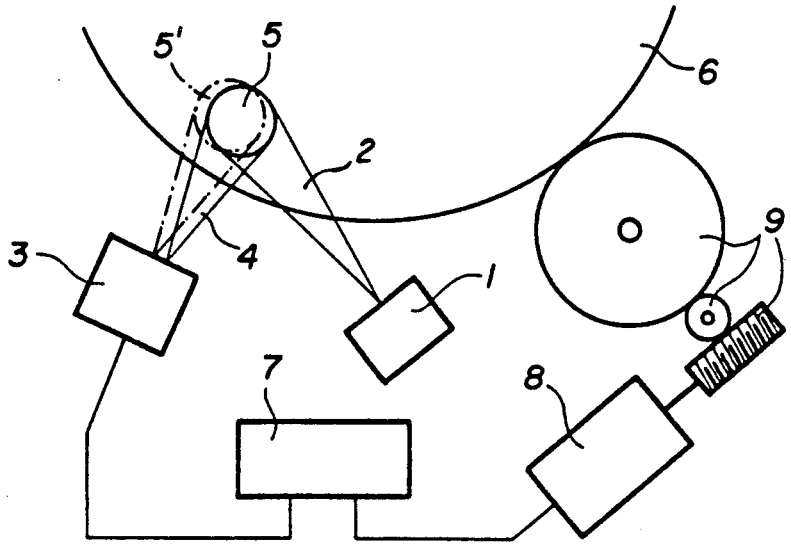

The motor 28*c* is coupled to the date disk 29*d*. This motor only advances once a day at midnight, and as the amount of energy to be supplied to the date is great, one may be led to perform a large number of steps with an adequate mechanical reduction at the date disk, within a time span of roughly one second (one hundred steps, for example). With reference to FIG. 3, the detection device essentially comprises a source 1 emitting a beam of light 2, for example a diode emitting infrared light, and a receiver 3, which is advantageously formed by photovoltaic cells, which is intended to intercept the reflected beam 4 returned by a very reflective area 5, such as a polished spherical dome. This very reflective area is integral with a surface of a moving part 6 which is, for example, the wheel bearing the hand, and in particular the wheel bearing the second hand. Depending on the position of the wheel, the very reflective surface may occupy a position corresponding to the reference 5 or an adjacent position, staggered for example by less than one step, corresponding to the reference 5'.

The signals from the detector are transmitted to an electronic circuit 7, which is connected to an electric motor 8 which drives said moving part 6 by means of a train of wheels 9.

Figure 4A:
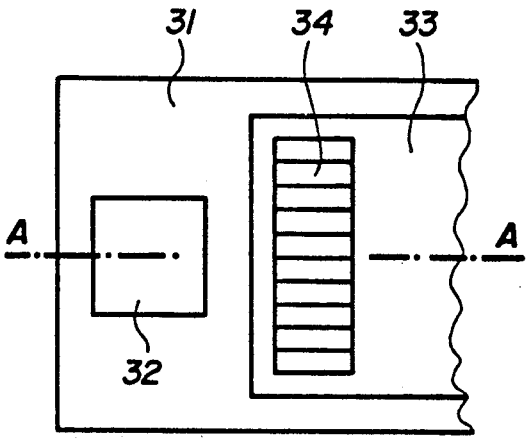

FIG. 4A is a plan view of the actual detection device. This device is placed in the watch beneath the wheel integral with the hand, for example the second hand. The sectional line A—A is orientated according to the direction of the radius of this wheel.

Figure 4B:
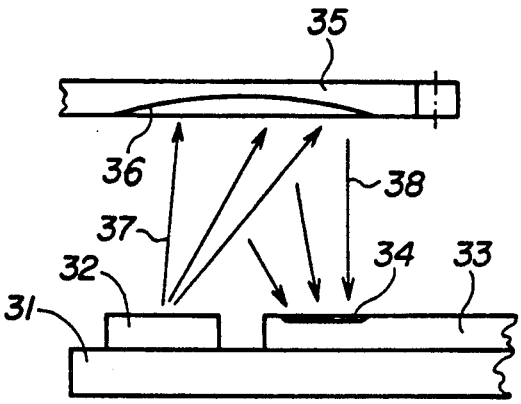

FIG. 4B is a sectional view, along line A—A, of the detection device and of a part of the wheel 35 integral with the second hand. This detection device comprises a support 31, which also forms the support of the integrated electronic circuits of the watch. On this support is mounted an emitter 32, which is, for example, a diode made of gallium arsenide of the type SFH 950 marketed by SIEMENS and emits an infrared light when it is switched on. This support also bears a receiver 33 comprising a row of photovoltaic cells 34, which are sensitive to the infrared light emitted by the diode 32 and circuits (not shown by this figure) for processing the signal emitted by the cells. These circuits are condensed into a monolithic integrated circuit manufactured by CMOS technology—standard low voltage for horological products. The row of photovoltaic cells 34 comprises, in the example shown, ten integrated photodiodes of the type P+P/N produced according to a standard manufacturing process (JSS IEEE 1987 Custom Integrated Circuits Conference, Pages 712 onwards) on the integrated circuit. They are placed along one edge of the latter, near the emitter 32. The number n of the cells is not restricted to ten.

As FIG. 4B shows more precisely, wheel 35, called the second wheel, is disposed above the detector. The surface seen by the detector is plane and dull, the incident light is partially absorbed, but a small amount of light is nevertheless diffused towards the set of photosensitive cells.

On this face this wheel comprises a polished mirror reflector which is shaped so that the incident light is focused and reflected onto a part of the row of photosensitive cells. This reflector provided in the wheel, or added on, is at such a distance from the centre of rotation that it passes above the detector half way from the emitter-receiver unit, for example in the middle of the row of photodiodes. The rays 37 of infrared light emitted by the diode 32 according to the well known Lambert's Law are, to a large extent, reflected and focused by the reflector 36 into a beam 38 on the row of photosensitive cells 34. The reflected rays of infrared light form a spot of light on three to four cells of the receiver, in as much as the reflector is located on the emitter-receiver optical path. When this condition is not met, all the cells receive a subdued light which is roughly equal for each of them.

Figure 5:
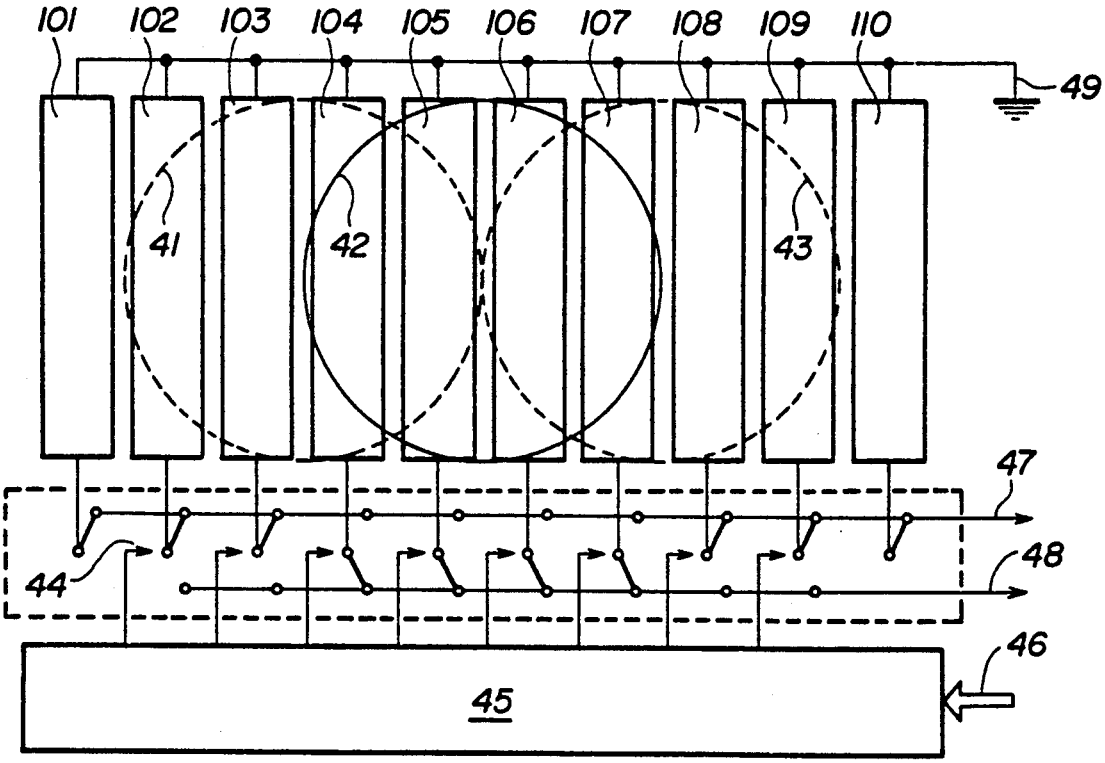
FIG. 5 illustrates the arrangement of the photosensitive cells.

FIG. 5 shows the arrangement of the row of photosenstive cells 101, 102, . . . , 110. There are ten of the latter in the example shown. The geometric shape of each cell is a rectangle in which the ratio between the length and the width is approximately 4. Thus, the regrouping of four contiguous cellls constitues a set of cells having an approximately square shape. The projection of the rays of light focused by the mirror integral with the second wheel is inscribed in a circle 41 or 42 or 43, the latter being itself inscribed in the square defined above. The width of each cell is such that for a displacement by an angle of 1.5° of the second wheel, the spot of reflected light is displaced by a distance equal to the width of a diode. An angular displacement of 1.5° corresponds to ¼ a step of the motor. It will therefore be understood that for one step the spot will be displaced by four cells, or that the resolution of the device is one quarter of a step.

Each cell corresponds to a diode, in which one of the two electrodes is common to the ten diodes. The common terminal 49 is connected to the earth potential of the circuit. To the other electrode is connected a switch for each diode, except for diodes 101 and 110. Each of these eight electronic switches 44 is individually controlled by a control circuit 45.

The electronic switches 44, controlled by the control circuit 45, enable the current of each of the eight diodes 102 to 109 to be shunted either onto a line 47, or onto a line 48, as a function of signals 46 transmitted to the control circuit 45.

In the example shown, the line 47 collects the currents from the diodes 101, 102, 103, 108, 109 and 110, and line 48 collects the currents from the diodes 104, 105, 106 and 107. This configuration shown by FIG. 5 corresponds to the case where the spot of reflected light occupies the central position 42.

Figures 6, 7:
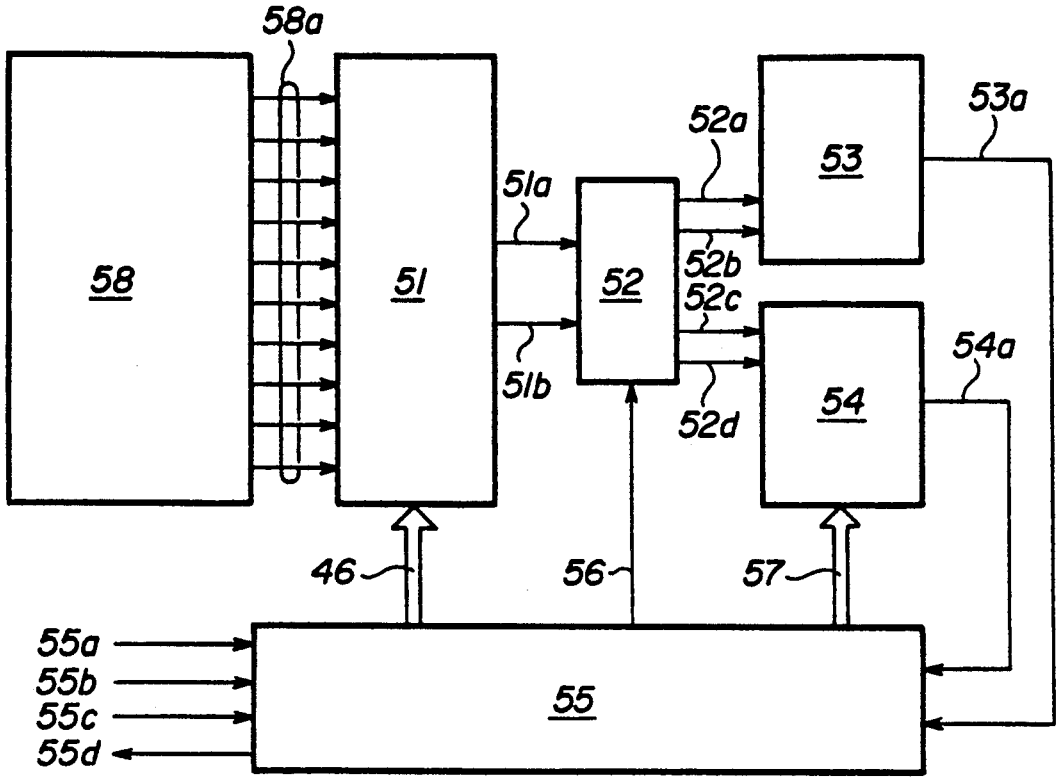
FIG. 6 shows a wiring diagram for the electronic circuit of the watch.
FIG. 7 shows the table of possible combinations of the photovoltaic cells of the detector.

FIG. 6 illustrates a wiring diagram for the electronic circuit of the optical detection device comprising:

a unit 51 which comprises the control circuit 45 for the eight switches and the eight switches themselves;

a unit 52 which is a signal shunt;

a unit 53 which defines the ratio of the output signals 52*a* and 52*b* of the unit 52;

a unit 54 which defines the ratio of the output signals 52*c* and 52*d* of unit 52;

a unit 55 which represents the management circuit for the optical detection device, and a unit 58 which represents the set of photosensitive cells of the detector.

Unit 51 is controlled by unit 55, by means of signals 46. The two outputs of this unit, respectively 51*a* and 51*b*, are the currents collected by lines 48 and 47 in FIG. 5.

Unit 52 is controlled by circuit 55, by means of signal 56. This shunt may assume two configurations depending on the logical state of signal 56. A first state enables the signals 51*a* and 51*b* respectively to be shunted to the outputs 52*a* and 52*b* and the second state enables signals 51*a* and 51*b* respectively to be shunted onto the outputs 52*c* and 52*d*.

Unit 53 produces the ratio of signals 52*a* and 52*b* which are of currents Ia and Ib, Ia being the sum of the currents of four contiguous diodes inscribed inside the row of photosensitive cells, Ib being the sum of the currents of the six remaining diodes, at the ends of the row of photosensitive cells. Apart from calculating the ratio Ia/Ib, this unit supplies a logical output signal 53*a* when the ratio Ia/Ib is maximal.

Unit 54 produces the ratio of the input signals 52*c* and 52*d*, i.e. Ia/Ib, and compares this ratio with a predetermined value chosen from three values $k_1$, $k_2$ and $k_3$ which define the thresholds of detection of the very reflective area. This choice is controlled by unit 55, by means of signals 57.

Unit 55 is a sequential logical circuit controlled by the signals 55*a*, 55*b*, 55*c* described below. It processes response signals 53*a* and 54*a*, and supplies an output signal 55*d* resulting from this processing operation.

The logical control signal 55*a*, when it assumes the logical level "1", controls the search for the maximum value for the ratio of current Ia/Ib. The logical control signal 55*b*, when it assumes the logical level "1", controls the comparison of the current ratio Ia/Ib with the threshold value $k_2$. The logical control signal 55*c*, when it assumes the logical level "1", controls the comparison of the current ratio Ia/Ib with the threshold value $k_3$. The logical control output signal 55*d* of unit 55 assumes the logical value "1" if one or the other signals 53*a* or 54*a* is as the logical state "1". The logical control signal 56 controls the shunting unit 52 already described. The logical signals 57 control one of the three values $k_1$, $k_2$ or $k_3$, which will serve for the comparison of the signal Ia/Ib with $k_1$, $k_2$ or $k_3$.

The zero detection device as described is based on the principle of use of an optical system in reflection which has an important advantage due to the fact that there is no incidence, such as friction or restriction of movement, in the position of rest defined in other respects by the positioning element of the stepping motor on the wheel.

An electroluminescent diode illuminates the wheel which possesses, at a defined distance from the centre of rotation, a parabolic mirror or, in a simplified version, a dome which is spherical in shape or possibly has another easily machinable shape in a brass wheel. This mirror collects a large part of the solid angle of the light emitted, condenses it and reflects it onto a row of photosensitive cells. The image thus formed extends over three or four cells, with one row having ten cells, for example. The geometry is such that for any position of the mirror inside one step and the next step, the image falls at random between the two ends of the row of photosensitive cells. This emitter-mirror-row of cells configuration is the first element of the device described. It will obviate the need to position the wheel during assembly, according to a particular orientation, so as to have a single optical path.

As the wheel supports the reflective element half way across the emitter-detector optical path, for two positions of the wheel spaced by one step, the image on the row of cells will be displaced two times more. This mechanism for amplifying a displacement distance enables cells having a greater width to be designed for one displacement and a given number of cells.

Each photosensitive cell supplies a current proportional to the intensity of light received. When several cells are connected in parallel, a new cell is formed, in which the current is the sum of the currents from each elementary cell. This principle is systematically applied to form two groups of cells: a first group I of four contiguous cells and a second group II comprising the six remaining cells. The first cell and the last cell of the row always form part of the second group and in this way the grouping of the four cells is always inside the row. For a row of ten cells, the number of possible arrangements according to the above rule is five. These arrangements are defined by the table represented by FIG. 7.

The part of the device processing signals is based on the measurement of the ratio of the currents supplied by the cells of group I and group II. It is evident that the problems of the temperature sensitivity of the cells, and of the variation in the electrical-optical efficiency of the diode during the course of time are simply eliminated. The ratio of the currents supplied respectively by group I and by group II therefore only depend on the position of the reflector of the second wheel. When the reflector is distant from the emitter-receiver optical path, all the cells receive an identical light, and the ratio is then $\frac{2}{3}$ (four cells to six cells), regardless of the absolute level of the currents. When the spot of light reflected by the mirror falls precisely on the four diodes of group I, the ratio may reach a value much greater than 10.

The operation of the device is such that it obviates the need to apply particular orders for the orientation of the wheel integral with the second hand, owing to the fact that the optical detector itself adapts to the orientation of the wheel. In other words, as the detection device is fixed and the wheel can assume any angular position, the electronic system chooses and memorises the optimal configuration of the photosensitive cells from the arrangements A1, A2, A3, A4 or A5, i.e. it will select the four contiguous cells which are the best placed in the row. There is therefore apprenticing or automatic adaptation to the position of the wheel.

The operation of the device comprises three distinct modes, viz: the apprenticing mode, normal operation and the operating safety test.

The operating safety test is not an indispensable mode, but it is can be easily applied and it offers an additional advantage which is not insignificant.

The apprenticing mode is active with each battery change and does not require any particular action by the horologist. In this mode, the electronic system has to find and memorise the best arrangement of the photosensitive cells, as a function of the orientation of the second wheel. Two cases may arise:

In a first case, the movement of the watch has been dismantled, the second hand has been removed from its axle. Therefore a new battery has to be put into position and the apprenticing and memorisation process have to be allowed to proceed. After this process, the horologist moves the second hand on its axle into the precise zero position (hand at 12 o'clock).

In the second case, the watch has not been dismantled. When a new battery is connected, the apprenticing process proceeds in an identical manner and results in the correct repositioning of the second hand and in the appropriate choice of the optimal arrangement of the optical pick-up and its memorisation.

The device therefore always displays the same behaviour when the battery is changed. This behaviour constitutes the said apprenticeship. The signal 55*a* is activated, the two currents are shunted onto the unit 54, the ratio $k_1$ is chosen ($k_1$ may be 1, for example) and the five possible arrangements are tested sequentially. If the reflector is outside the optical path and the ratio $k_1$ is not exceeded, then the motor advances by one step. This procedure is repeated until the ratio $k_1$ is exceeded for at least three successive arrangements. From this moment, the selector 52 shunts the two currents into the unit 54. The five arrangements are then tested sequentially and the ratio of the maximal current detected corresponds to the best centred arrangement with respect to the reflected spot of light. This arrangement A1, A2, A3, A4 or A5 is memorised. The motor stops on the position detected, the apprenticing mode is over. At the time of this apprenticing phase, the testing of the five arrangements is performed for each step of the motor for which the threshold $k_1$ has been exceeded. The set of juxtaposed photovoltaic cells, which form the detector, must be sufficiently large so that the spot of reflected light covers one step. The test may result in two positions for which the ratio of the currents is maximal. To avoid this drawback, an item of information relating to the polarity of the step is also detected and memorised. If it is known that a maximum value is obtained for an even number, during apprenticing, eventually the test will only be carried out for even numbers, which will enable any ambiguity to be removed, given that the detector is not sufficiently long to cover two successive even steps. The same reasoning may be carried out with uneven steps.

The normal operating mode enables the identity between the electronic scaling of the second and the mechanical position of the second hand to be verified once every minute at the "zero" second. The signal 55*b* (FIG. 5) is activated when the electronic second counter is at zero. Only the arrangement memorised is formed in the unit 51. The ratio of currents Ia/Ib is compared to the predetermined value $k_2$ (this value may be 5, for example). If the ratio of currents is greater than $k_2$, the signal 54*a* passes at "I" and the "zero" position is identified.

It may occur that the second motor misses one or several steps, for example after great shocks. The test described above enables the absence of a signal to be detected, signal 54*a* remains at "0". For the electronic control system 25–26 (FIG. 2) of the second motor it is therefore a matter of making said motor advance by one step. The verification procedure described above is then repeated. This process of advancing by one step of the motor and of verifying the "zero" position is repeated unitl the signal 54*a* passes "1". At this moment, the "zero" position of the second hand is then reached. This process occurs very quickly. In fact the advance by one step of the second motor lasts less than 9 milliseconds and the position test lasts less than 1 millisecond, so that the 60 successive positions of the second hand may be tested in 0.6 seconds. It may therefore be concluded that the exact position of the second hand is located in less than one second, irrespective of the number of missed steps at the time of the last minute elapsed. If this correction procedure is activated, it is possible to supply the motor with greater energy than at normal times to ensure correction by prolonging the duration of the control pulse of the motor. Thus the risk of supplying minimum energy to the second motor in normal time may be taken, in the knowledge that any missed steps are corrected with a greater energy. Therefore as consumption can be reduced, the autonomy of the watch will be extended.

In production, it is useful, even indispensable, to check the correct operation of the components of the watch, and more precisely to verify if a predefined safety factor is respected. By way of example, an integrated circuit which has to operate with a power of 1.5 V will be checked at 1.2 V. Thus the testing of the zero detection device may be specified. By imposing a logical signal 55*c* (FIG. 6) at the input of unit 55, one acts on the choice of the ratio k imposed at the unit 54 by internal signals 57. In test mode, the ratio $k_3$ is used and this ratio $k_3$ is chosen so that it is twice as large as the ratio $k_2$ used in normal operating mode, so that if $k_2=5$, $k_3=10$. With this high ratio, the detection of the "zero" position must still operate.

The test procedure is therefore as follows: the logical signal 55*c* is imposed, a new battery is installed and if the zero detector still operates normally, the second hand advances rapidly and stops at the "zero" position. In the contrary case, the hand advances at high speed and does not stop. As the search for the "zero" position is continuous, the safety factor is not enforced.

In practice, the advance of the motor will be limited to 64 steps, for example, i.e. a little more than one revolution.

In the above description, the device is connected to a second hand, but naturally it may also be connected to another moving part of the watch.

We claim:

1. A device for detecting a zero position of a hand, comprising a drive motor for driving said hand and an electronic means for controlling said motor, said device further comprises a surface integral with a moving part supporting said hand, said surface comprising a slightly reflective zone and a very reflective area, an emitter positioned to emit and direct beam of light onto said surface, a detector formed by a set of n photovoltaic cells for detecting a refection by said surface of said beam, and means for determining an angular position of said surface for which an output signal of said detector is at a maximum and making that position correspond to the zero position of said hand when said watch is assembled, and wherein the set of n photovoltaic cells of said detector is subdivided into two groups comprising a first central group of p contiguous cells and a second lateral group of n-p cells and, said electronic means calculates a ratio of currents from said first and second groups of cells and determines a maximum value of this ratio, and wherein said p cells of said first group switched between said n-p cells of said second group, and wherein said electronic means comprises means for determining the threshold value ($k_1$) of the ratio of the currents of said first and second groups, and means for determining the position of the moving part supporting said hand for which the ratio of the currents exceeds said threshold value, and means for determining the arrangement for which this ratio is at a maximum;

and wherein said electronic means comprises means for memorizing the arrangement for which the ratio is at a maximum, and means for comparing, once every revolution, a mechanical position of said hand and determining a theoretical position of said hand by electronic scaling.

* * * * *